US006460232B2

(12) United States Patent
Maruoka

(10) Patent No.: US 6,460,232 B2
(45) Date of Patent: Oct. 8, 2002

(54) BUCKLE

(75) Inventor: Hiroyuki Maruoka, Yokohama (JP)

(73) Assignee: Nifco Inc., Yokohama (JP)

( * ) Notice: Subject to any disclaimer, the term of this patent is extended or adjusted under 35 U.S.C. 154(b) by 0 days.

(21) Appl. No.: 09/771,710

(22) Filed: Jan. 30, 2001

(65) Prior Publication Data

US 2001/0013159 A1 Aug. 16, 2001

(30) Foreign Application Priority Data

Feb. 10, 2000 (JP) ..... 2000-033482

(51) Int. Cl.[7] ..... A44B 11/25; A44B 11/26; A44B 17/00

(52) U.S. Cl. ..... 24/615; 24/625; 24/614

(58) Field of Search ..... 24/614, 615, 616, 24/625, 651

(56) References Cited

U.S. PATENT DOCUMENTS 4,150,464 A * 4/1979 Tracy ..... 24/313
4,688,337 A * 8/1987 Dillner et al. ..... 24/616
5,465,472 A * 11/1995 Matoba ..... 24/625
5,791,026 A * 8/1998 Anscher ..... 24/615
5,794,316 A * 8/1998 Anscher ..... 24/625
5,926,928 A * 7/1999 Lundstedt ..... 24/625
6,247,213 B1 * 6/2001 Uehara ..... 24/625

* cited by examiner

*Primary Examiner*—Robert J. Sandy
(74) *Attorney, Agent, or Firm*—Kanesaka & Takeuchi

(57) ABSTRACT

A buckle is formed of a female buckle in a hollow shape, and a male buckle including an insertion section to be inserted into the female buckle. The insertion section includes a middle leg, and elastic legs with engaging projections disposed at both sides of the middle leg. The female buckle includes engaging windows engaging the engaging projections of the elastic legs. The elastic legs are elastically deformed inwardly upon insertion operation of the insertion section, and at a predetermined position, the engaging projections enter into the engaging windows elastically. Also, the female buckle includes a pair of dividing plate portions for guiding and holding the middle leg therebetween, and the dividing plate portions extend between inner walls of the female buckle which face each other.

9 Claims, 21 Drawing Sheets

BUCKLE

BACKGROUND OF THE INVENTION AND RELATED ART STATEMENT

The present invention relates an improvement of a buckle, which is formed of a female buckle in a hollow shape, and a male buckle engaging the female buckle through an insertion section of the female buckle, to thereby connect a member or an article attached to the male buckle and a member or an article attached to the female buckle by engaging the male buckle with the female buckle.

Conventionally, there has been known a buckle, which is formed of a male buckle including an insertion section formed of a middle leg and elastic legs provided at both sides of the middle leg; and a female buckle in a hollow shape, which receives the insertion section of the male buckle while the elastic legs thereof are inwardly bent. The female buckle includes engaging windows which receive engaging projections provided at the elastic legs by the elastic return of the elastic legs at predetermined insertion positions, so that the engaging windows are engaged with the engaging projections.

In the buckle, the male buckle and the female buckle are connected by the engagements of the engaging projections of the elastic legs of the male buckle with the engaging windows of the female buckle, and by connecting the male and female buckles, a connection of bands, belts, straps or the like is carried out. Also, when the engaging projections are pressed through the engaging windows so that the elastic legs are inwardly bent again, the engagements between the engaging projections and the engaging windows are released, and the insertion section of the male buckle can be pulled out from the female buckle. Accordingly, connection of the belts or the like can be released by the separation of the male buckle from the female buckle.

However, in this kind of buckle, since the female buckle is formed of a simple hollow shape including the engaging windows, in the separated condition of the buckles in which the insertion section of the male buckle is not inserted in the female buckle, in case a force for smashing the female buckle is applied to the female buckle, there is a limit in improving the strength of the female buckle.

Accordingly, a main object of the invention is to improve a strength of a female buckle in this kind of the buckle without deteriorating the function of the buckle and without making the structure thereof complicated.

Further objects and advantages of the invention will be apparent from the following description of the invention.

SUMMARY OF THE INVENTION

To achieve the aforementioned object, the present invention provides a buckle which has the following structures (1) through (4) according to a first aspect of the invention.

(1) The buckle is formed of a female buckle having a hollow shape and including an introduction opening at at least one end thereof, and a male buckle including an insertion section to be inserted into the female buckle through the introduction opening thereof.

(2) The insertion section of the male buckle includes a middle leg, and elastic legs provided at both sides of the middle leg, and engaging projections are formed in the elastic legs at the sides opposite to sides facing the middle leg.

(3) The female buckle includes engaging windows engaging the engaging projections in the elastic legs. The elastic legs are elastically deformed inwardly by pressing the engaging projections against inner walls of one pair among two pairs of inner walls of the female buckle facing each other upon an insertion operation of the insertion section, and the engaging windows allow the elastic projections to enter thereinto by the elastic forces of the elastic legs at predetermined insertion positions.

(4) The female buckle also includes a pair of dividing plate portions, which guide the middle leg by holding the same therebetween in case of the insertion operation, and the dividing plate portions extend between the other pair of the inner walls of the female buckle among the two pairs facing each other.

According to this structure, by utilizing the pair of the dividing plate portions which guide an insertion of the insertion section of the male buckle by holding the middle leg of the male buckle therebetween, an inside of the female buckle in the hollow form can be supported, so that the strength of the female buckle can be improved without deteriorating the function of the buckle.

According to a second aspect of the invention, the insertion section of the male buckle according to the first aspect of the invention includes stopping portions between the middle leg and the elastic legs, and each of the stopping portions has a thickness to be held substantially tightly between the inner walls between which the dividing plate portions extend.

According to the above structure, in the engaging condition of the female and male buckles, in which the insertion section of the male buckle is inserted into the female buckle, the insertion section can be retained inside the female buckle without wobbling. In this situation, even if an external force in the direction of twisting the insertion section, which acts around a central axis of the female buckle, is applied, the engaging condition of the buckles can be maintained stably.

Also, according to a third aspect of the invention, the insertion section of the male buckle according to the first aspect of the invention includes stopping portions between the middle leg and the elastic legs. The stopping portions are provided for preventing bending of the elastic legs by abutting against the sides of the elastic legs facing the middle leg in case operations of bending the elastic legs inwardly are carried out through the engaging windows of the female buckle over the positions where the engagements between the engaging windows and the engaging projections located in the engaging windows are released.

According to this structure, amounts of deforming the elastic legs by the operations of bending the elastic legs inwardly in order to release the engagements between the engaging windows and the engaging projections can be maintained to be constant by allowing the stopping portions to abut against the elastic legs at predetermined positions of bending the elastic legs. While the elastic legs have rigidities which do not obstruct the bending operations, unexpected deformations or damages are fully prevented for the elastic legs which are caused by excessive deformation operations of the elastic legs.

Also, according to a fourth aspect of the invention, each of the stopping portions in the buckle according to the third aspect of the invention includes a thickness to be stored substantially tightly between the inner walls of the female buckle between which the dividing plate portions extend.

According to this structure, in the engaging condition of the buckles in which the insertion section of the male buckle is inserted into the female buckle, the insertion section can be held inside the female buckle without wobbling, and at the same time, the engaging condition of the buckles can be stably maintained even if the external force in a direction of twisting the insertion section acting around the axis of the female buckle is applied.

Also, according to a fifth aspect of the invention, the stopping portions in the buckle according to the second or fourth aspect of the invention are elongated in the direction of inserting the insertion section of the male buckle.

According to this structure, the stopping portions can be stored substantially tightly between the inner walls of the female buckle in a wide range along the axis of the female buckle, to thereby further prevent the wobbling of the insertion section stored in the female buckle.

DETAILED DESCRIPTION OF PREFERRED EMBODIMENTS

Hereunder, a typical embodiment of the invention will be explained with reference to FIG. 1 through FIG. 28.

Figure 1:
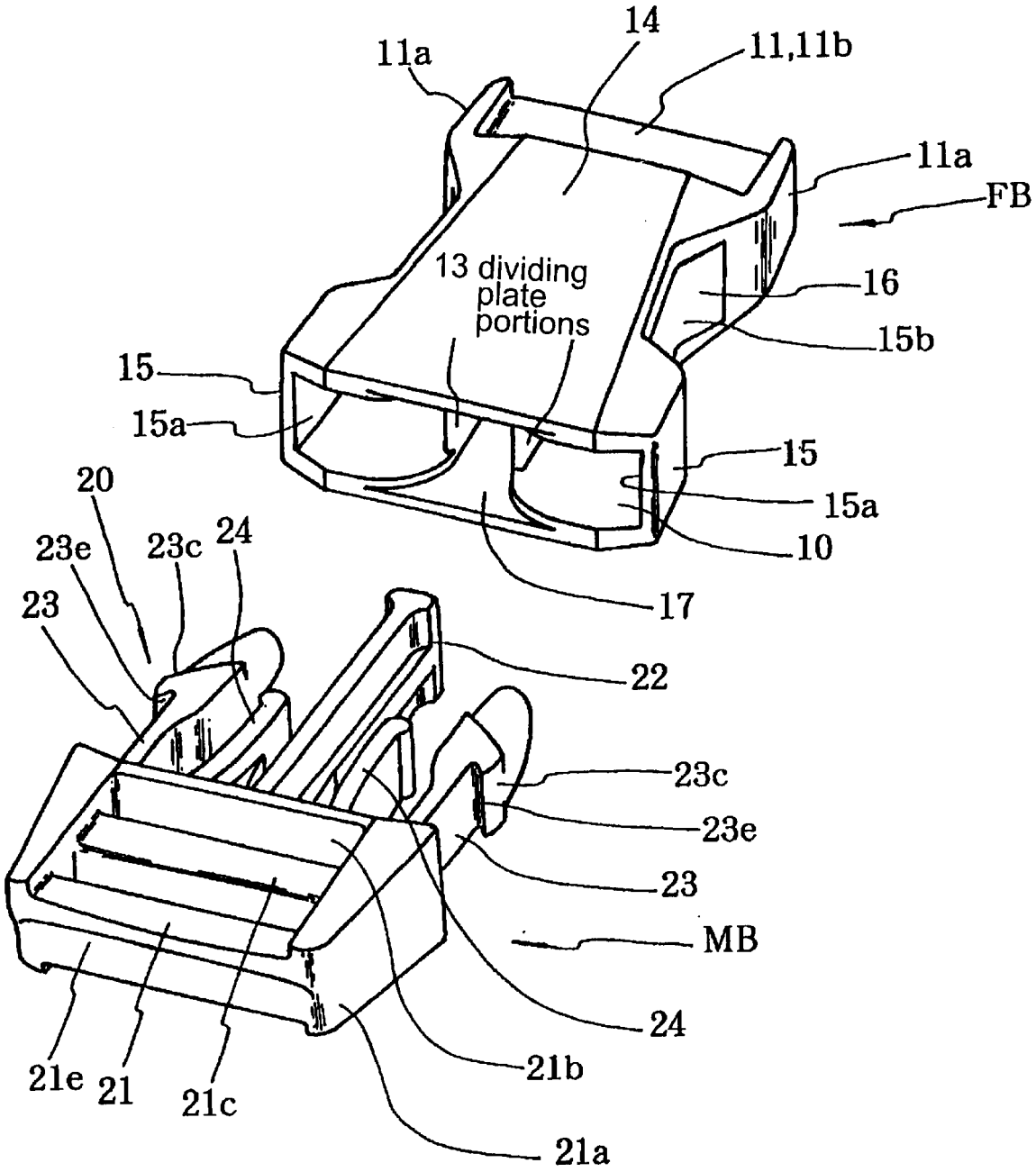
FIG. 1 is an exploded perspective view of a buckle of the invention.
Figure 2:
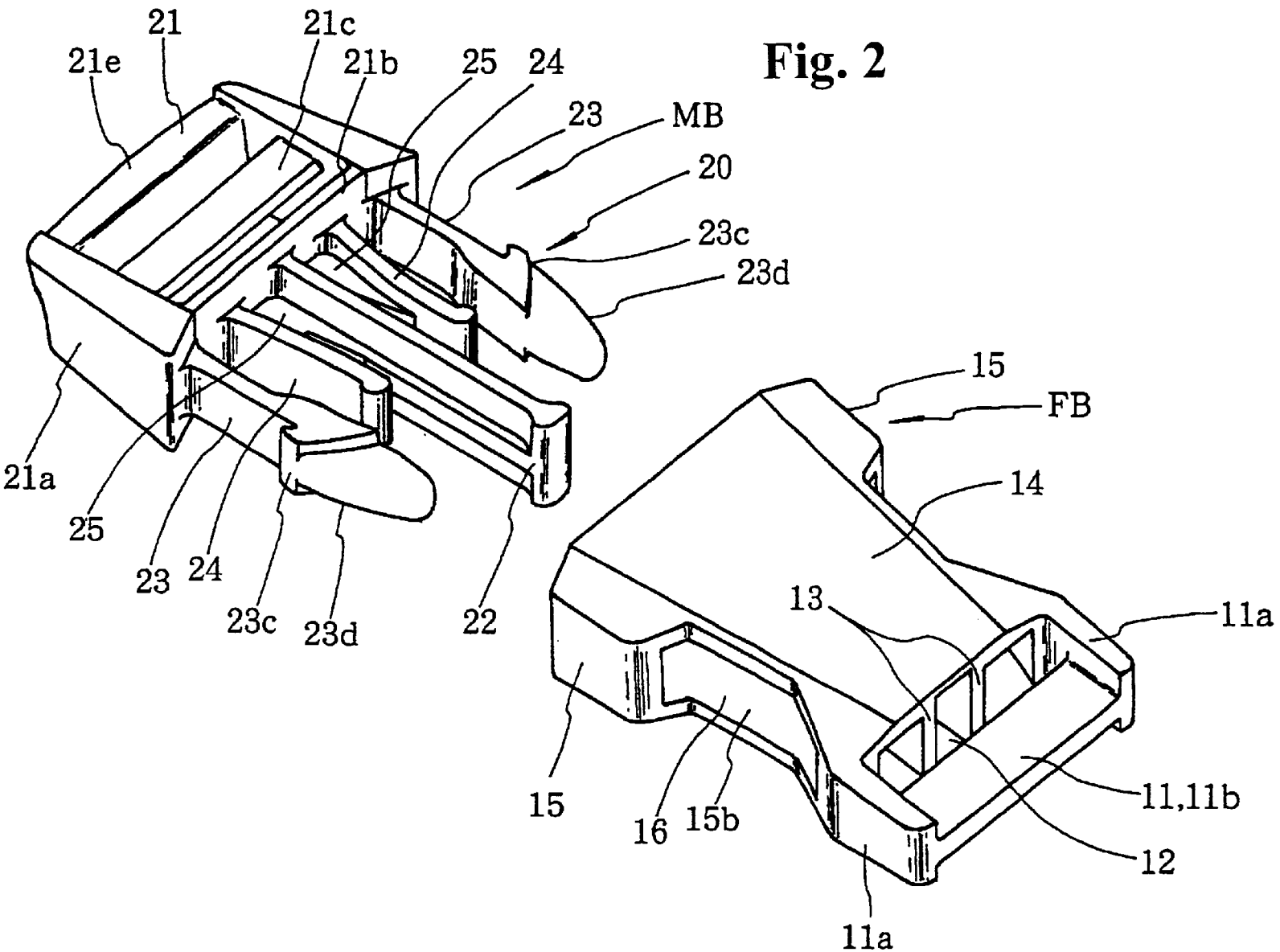
FIG. 2 is an exploded perspective view of the buckle in FIG. 1 as seen from a different direction.
Figure 3:
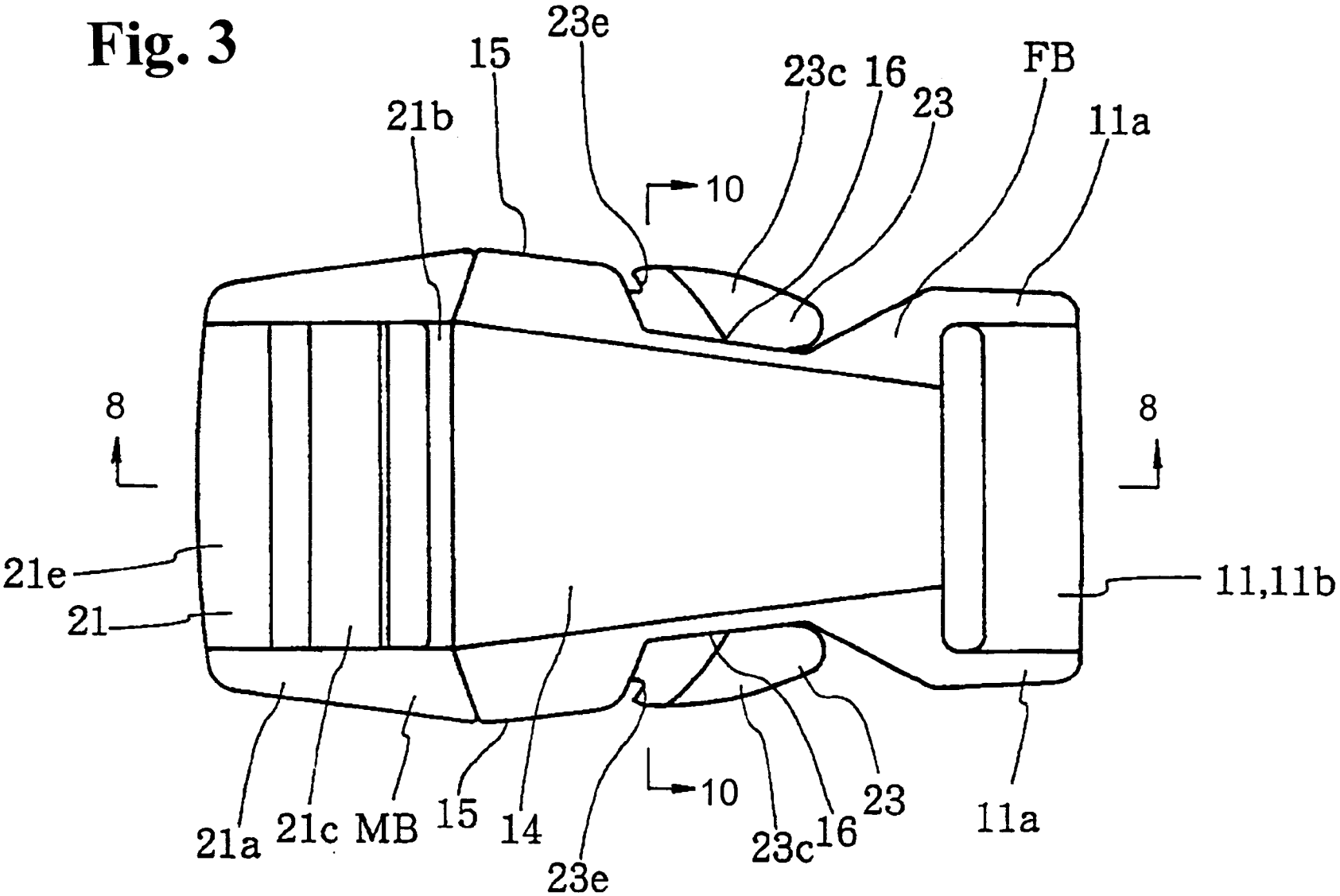
FIG. 3 is a plan view of the buckle in the engaged condition.
Figure 5:
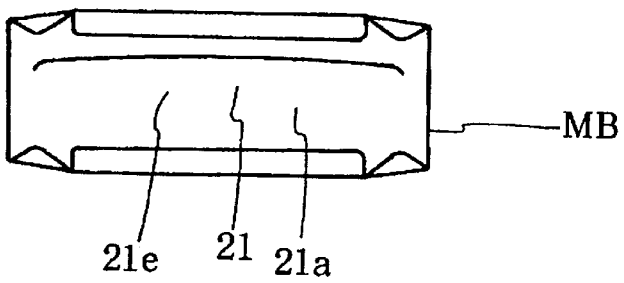
FIG. 5 is a left side view of the buckle in the engaged condition.
Figure 4:
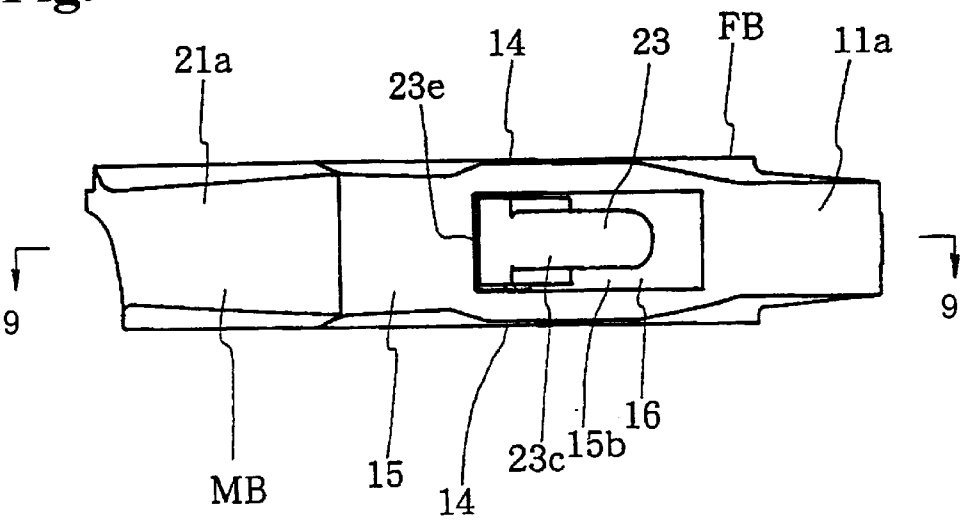
FIG. 4 is a front view of the buckle in the engaged condition.
Figure 6:
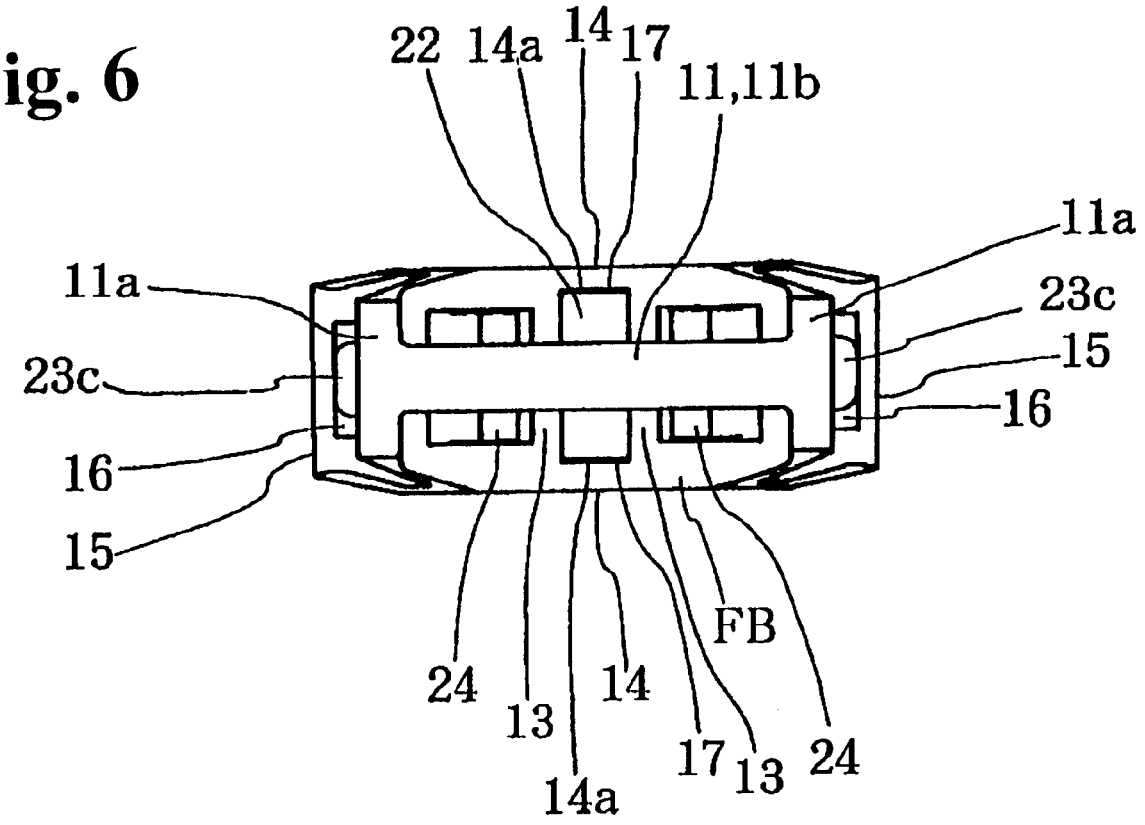
FIG. 6 is a right side view of the buckle in the engaged condition.
Figure 7:
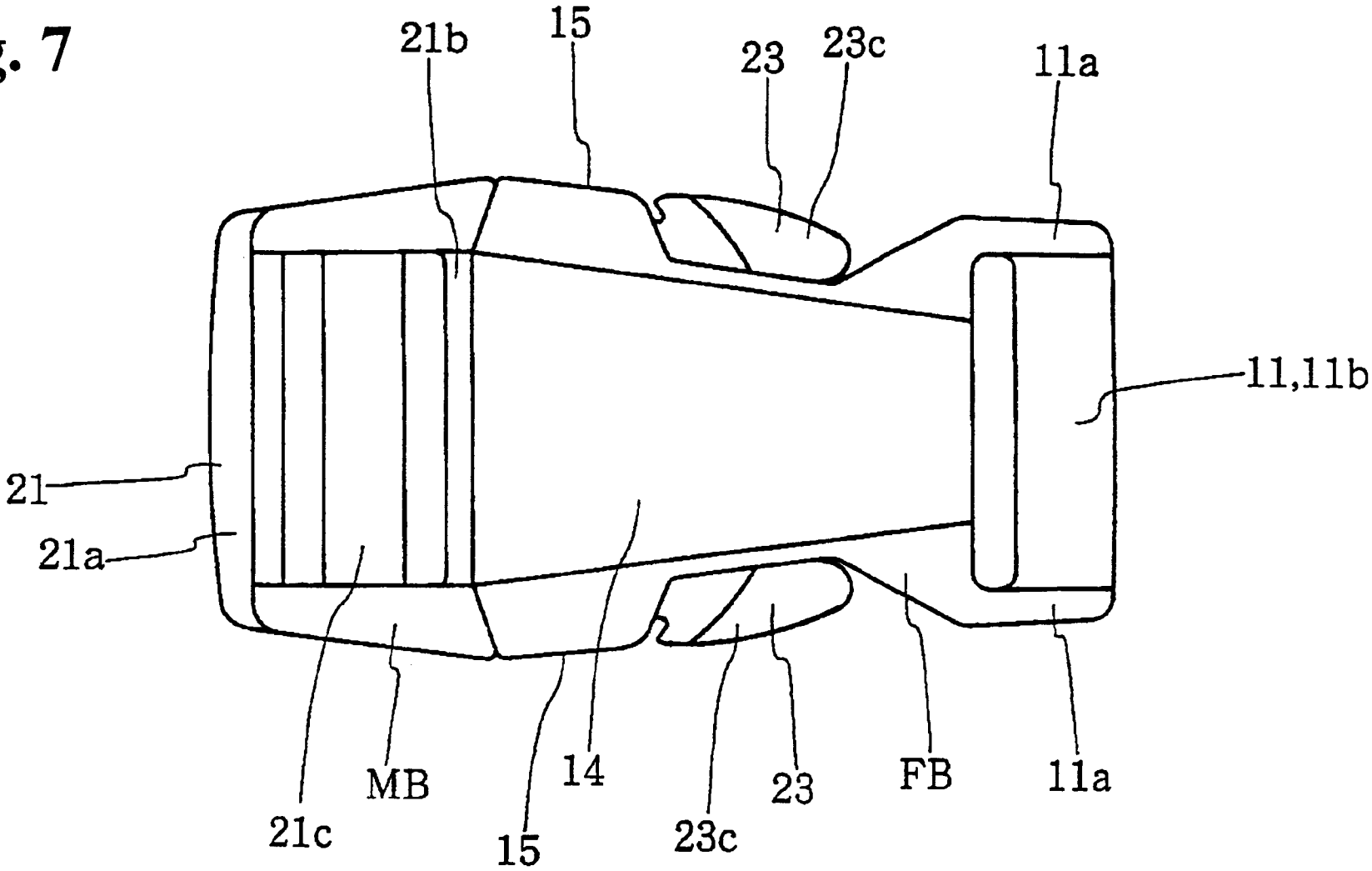
FIG. 7 is a bottom view of the buckle in the engaged condition.
Figure 8:
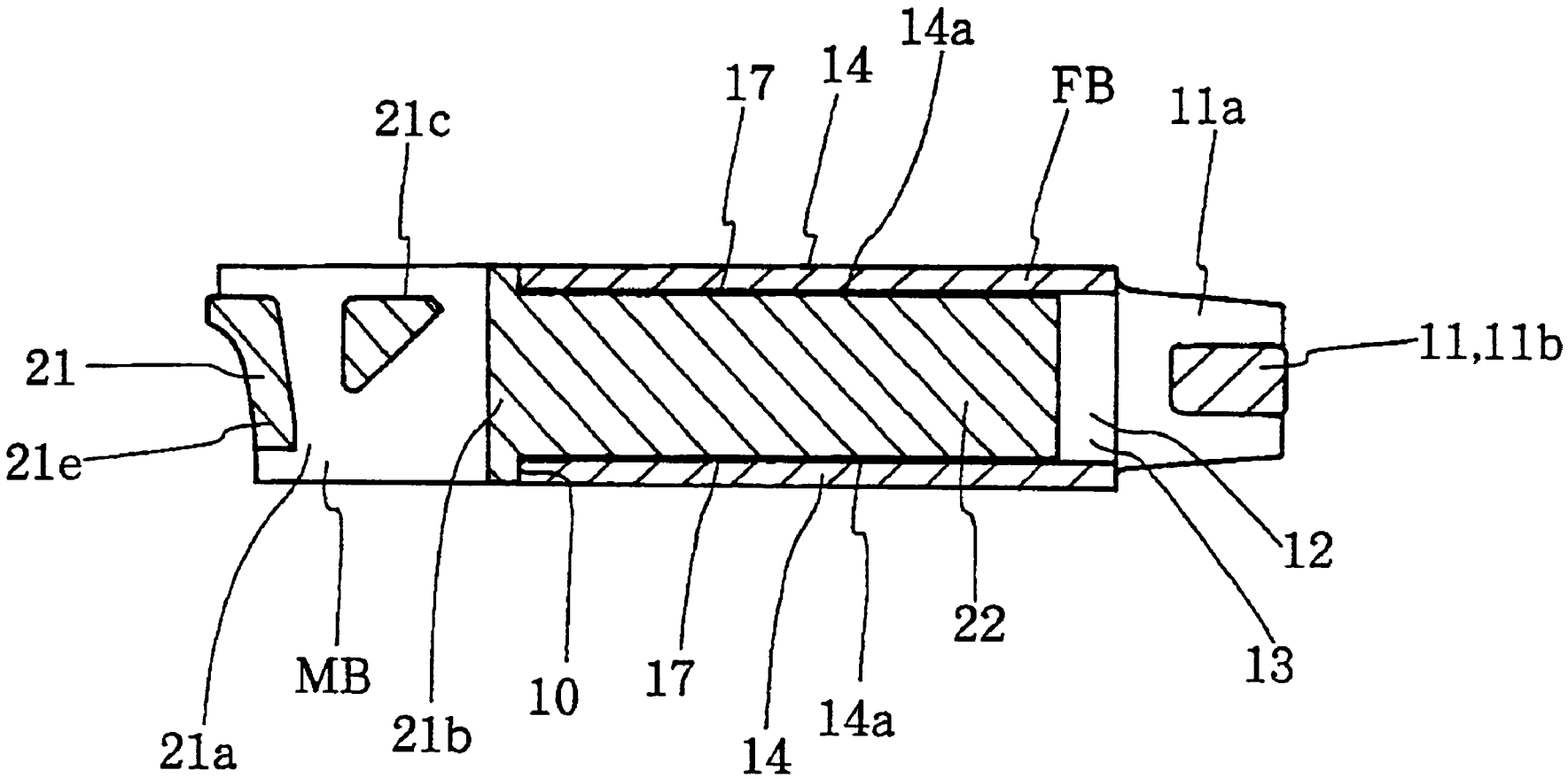
FIG. 8 is a cross sectional view taken along line 8—8 in FIG. 3.
Figure 9:
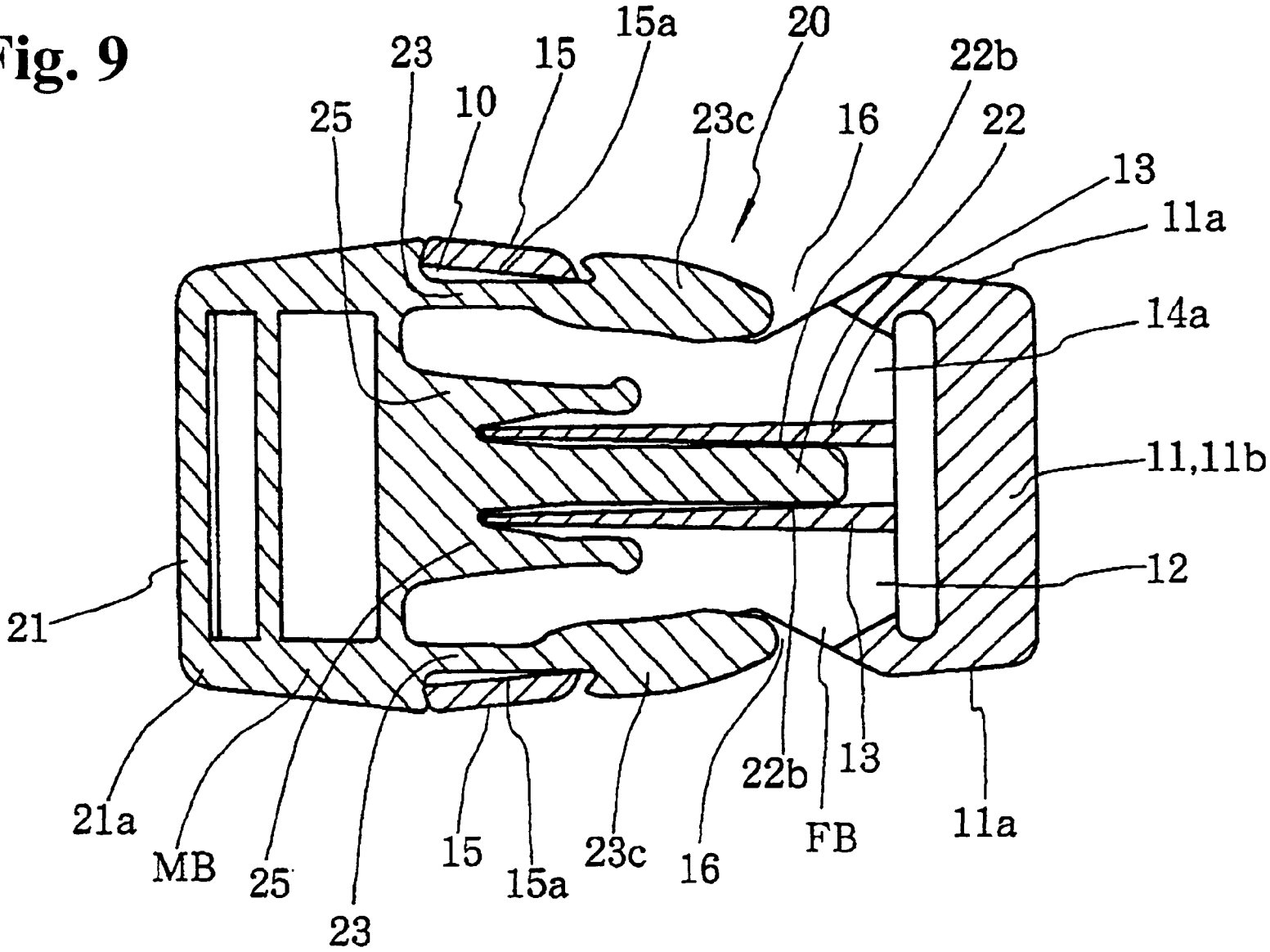
FIG. 9 is a cross sectional view taken along line 9—9 in FIG. 4.
Figure 10:
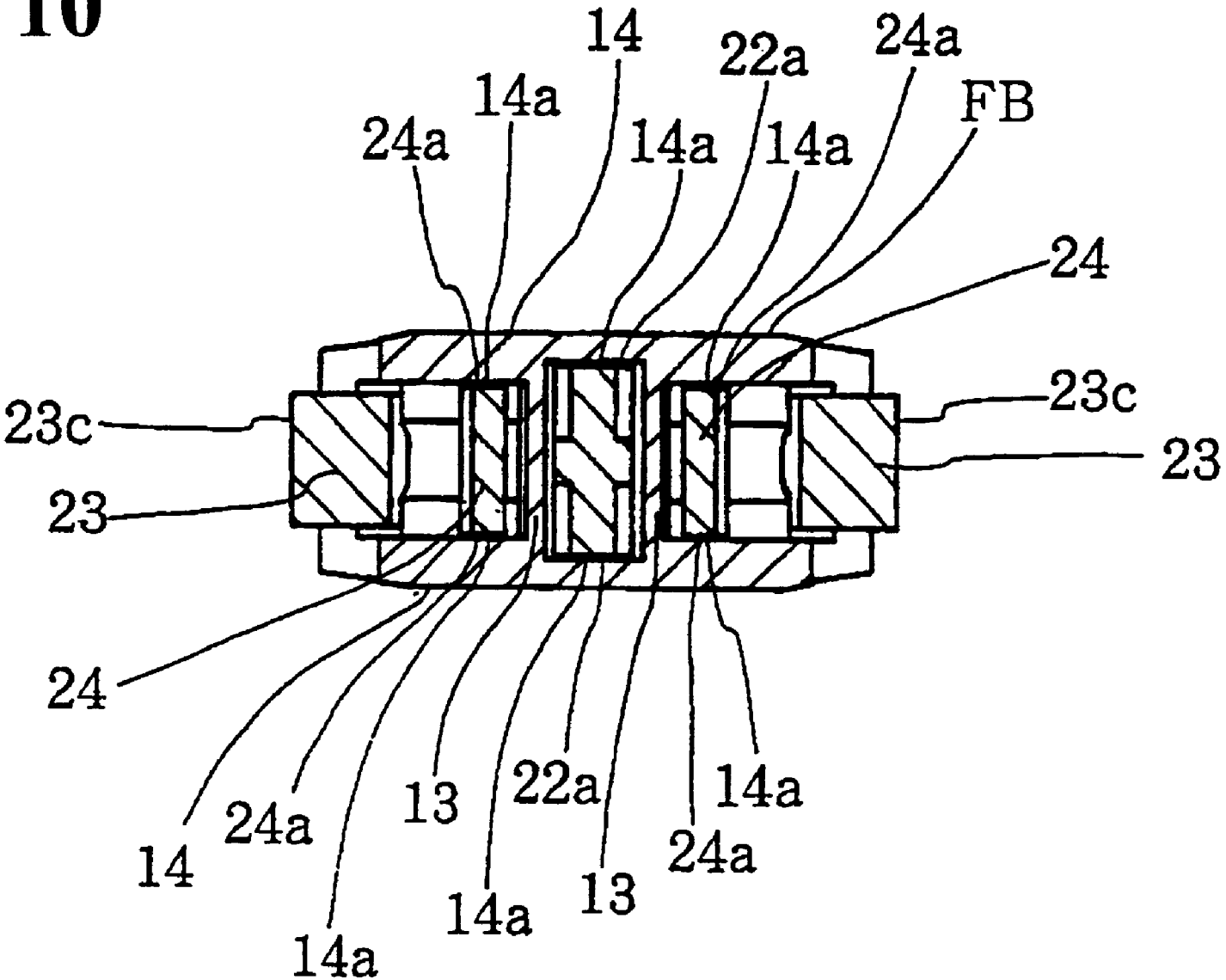
FIG. 10 is a cross sectional view taken along line 10—10 in FIG. 3.

Here, in FIG. 1 and FIG. 2, a female buckle FB and a male buckle MB, which form a buckle, are separated and shown in perspective views. Also, FIG. 3 through FIG. 10 show the condition that the buckles FB and MB are engaged with each other; FIG. 11 through FIG. 16 show the male buckle MB; and FIG. 17 through FIG. 23 show the female buckle FB.

Figure 24:
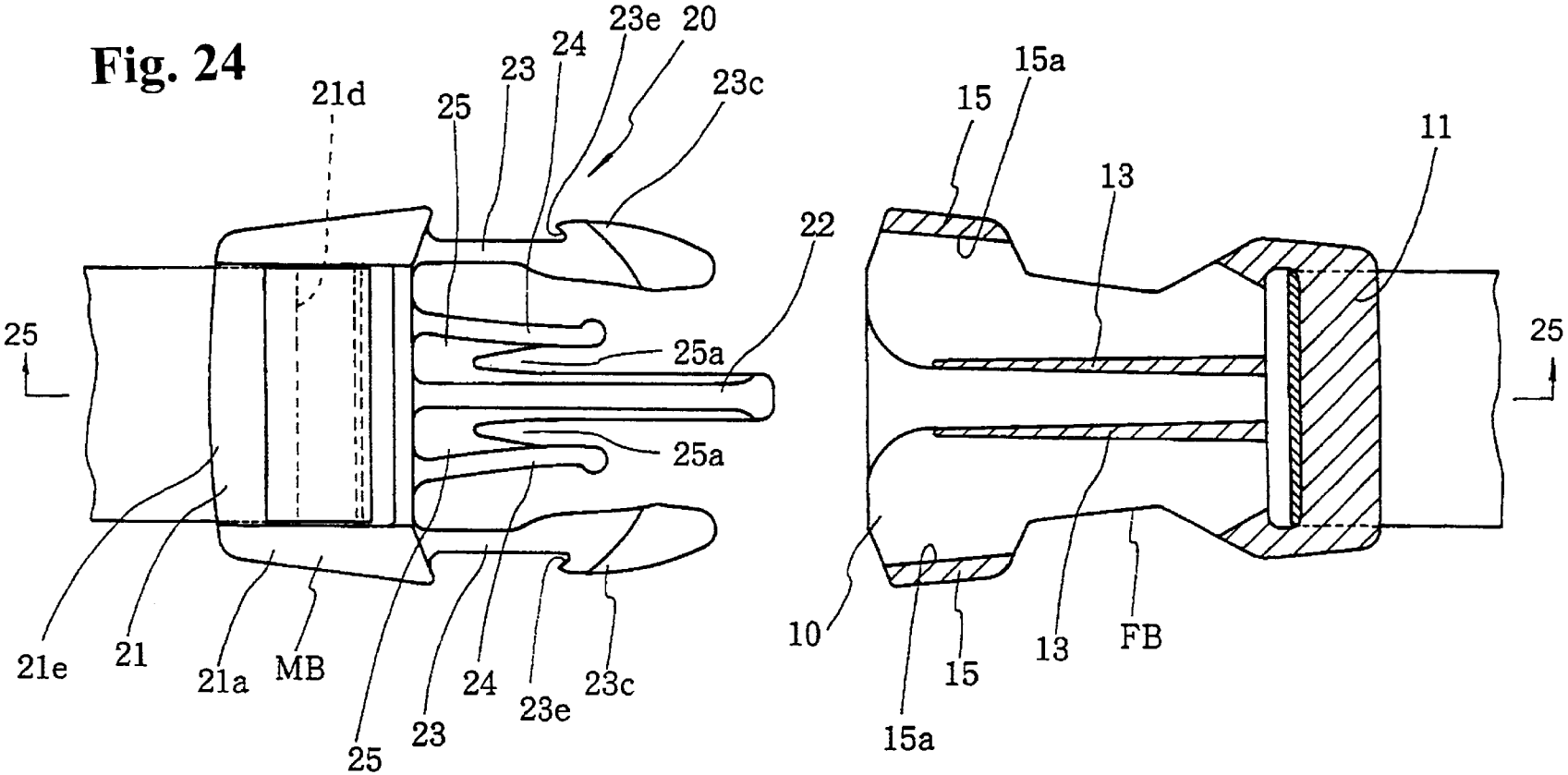
FIG. 24 is a partly cut plan view of the buckle in a separated condition, wherein the buckle is in use.
Figure 25:
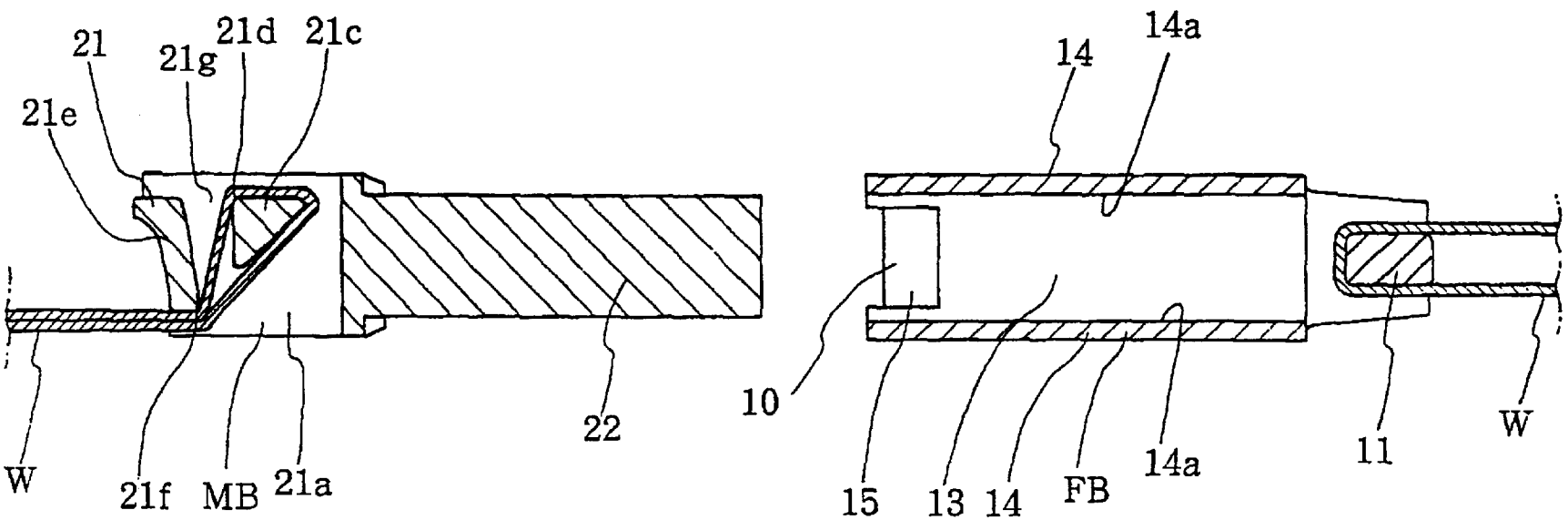
FIG. 25 is a cross sectional view of the buckle taken along line 25—25 in FIG. 24.
Figure 26:
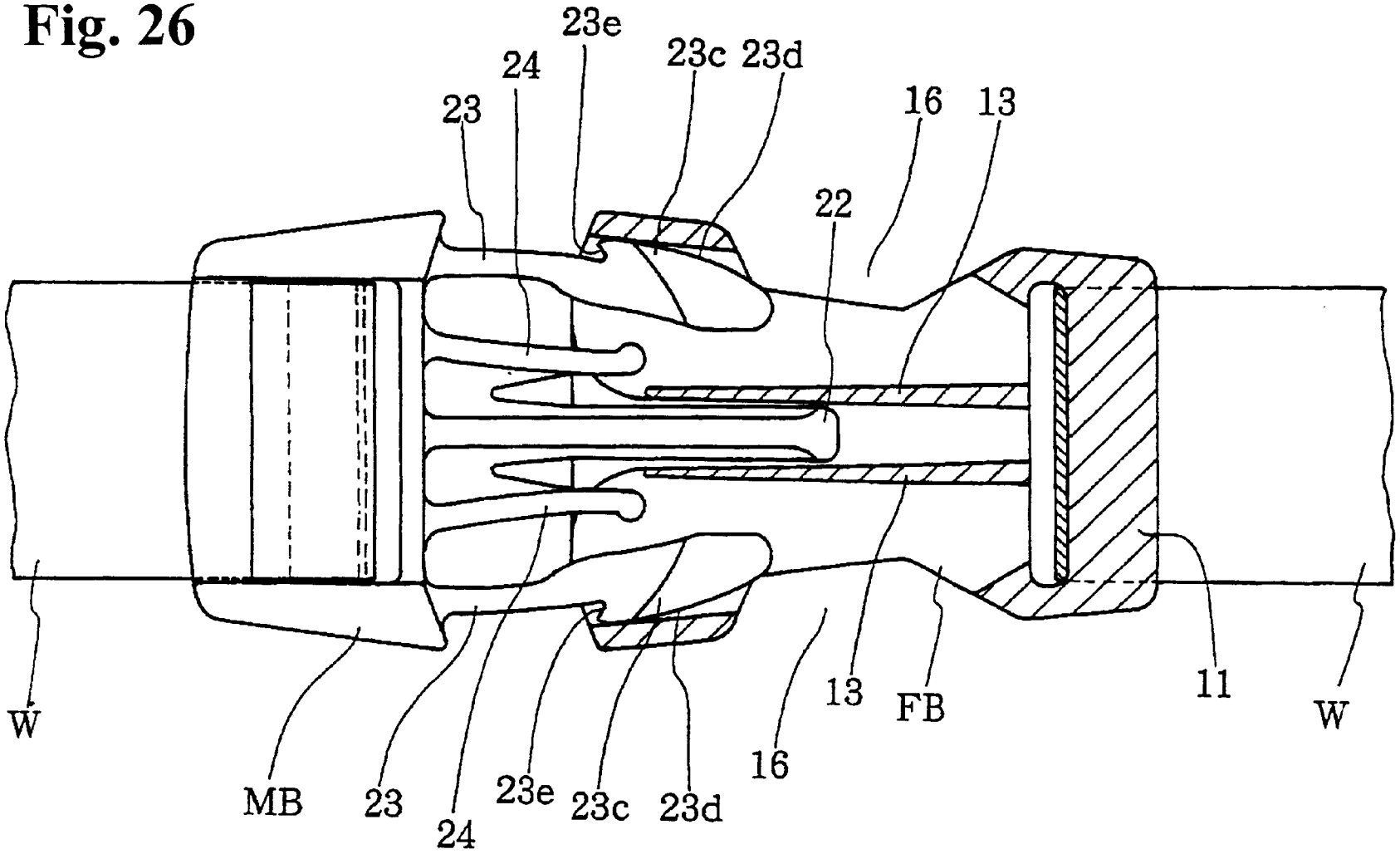
FIG. 26 is a partly cut plan view of the buckle in use.
Figure 27:
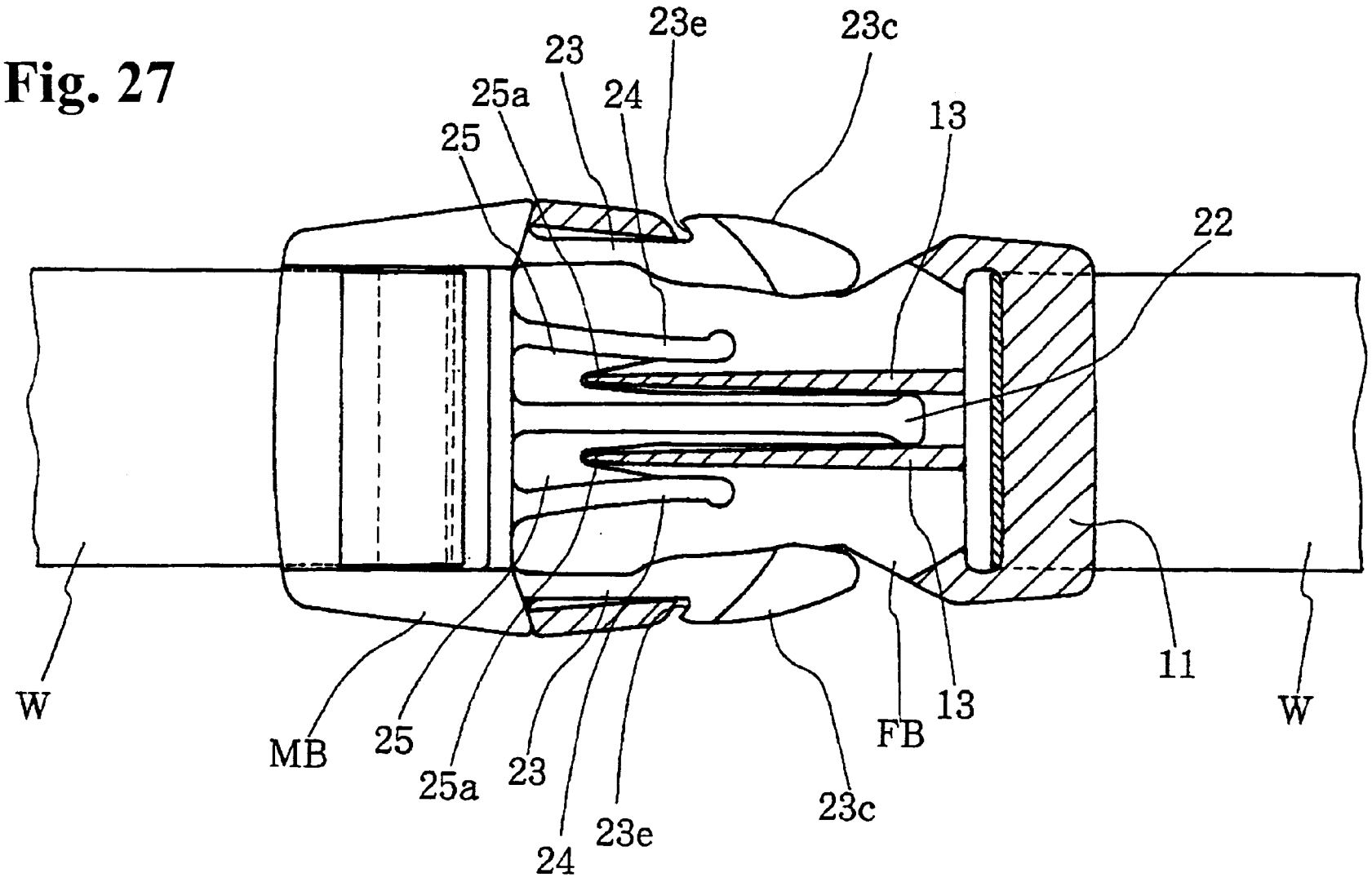
FIG. 27 is a partly cut plan view of the buckle in the engaged condition, wherein the buckle is in use.
Figure 28:
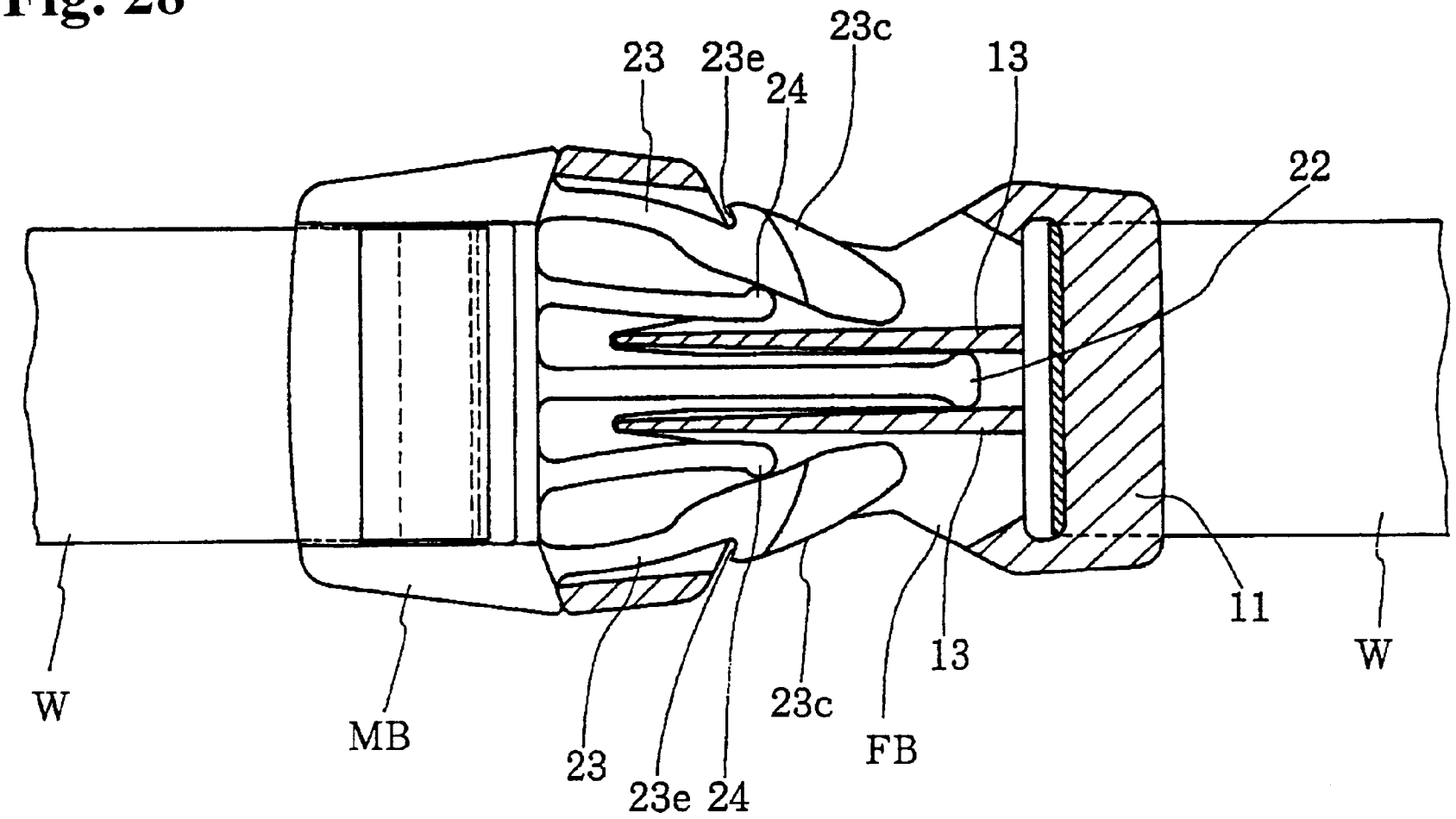
FIG. 28 is a partly cut plan view in the condition that an operation of releasing the engagement is carried out.

Also, FIG. 24 and FIG. 25 show the condition that the both buckles FB and MB attached with belts or bands are separated and positioned in a direction of engaging with each other; FIG. 26 shows a condition that the insertion section 20 of the male buckle MB begins to enter into the female buckle FB from the condition shown in FIG. 24; FIG. 27 shows a condition that the both buckles FB and MB are engaged with each other from the condition shown in FIG. 26; and FIG. 28 shows a condition that elastic legs 23 of the male buckle MB are inwardly bent through engaging windows 16 of the female buckle FB so as to release the engagement of the buckles shown in FIG. 26.

The buckle according to the embodiment of the invention is formed of the female buckle FB in a hollow shape including an introduction opening 10 at at least one end thereof; and the male buckle MB including the insertion section 20 to be inserted into the female buckle FB through the introduction opening 10 of the female buckle FB. By inserting the insertion section 20, both the buckles FB and MB are engaged, and the buckle is used for connecting a member or an article attached to the male buckle MB and a member or an article attached to the female buckle FB through the engagement of the buckles MB and FB.

In this embodiment, an attachment section 11 for a band W is formed in the buckle FB, and an attachment section 21 for a band W is formed in the buckle MB. It is structured that the bands W respectively attached to the buckles MB and FB at the attachment sections 11 and 21 can be connected or coupled by the engagement of the buckles FB and MB described above.

Namely, in this embodiment, the female buckle FB is structured in a flat hollow shape including the introduction opening 10 which is long in a lateral direction, and at the same time, the female buckle FB includes an end side opening 12 which is long in a lateral direction and disposed at the other end of the hollow shape, i.e, at an end of the hollow shape portion which is opposite to the end where the introduction opening 10 is located. Then, in a side of the end side opening 12, the female buckle FB includes the attachment section 11 for the band W, which is formed of side plates lha respectively projecting at narrow sides from an opening rim surrounding the end side opening 12, and an engaging rod 11*b* for the band W disposed to extend between the side plates 11*a*.

Also, the male buckle MB includes the attachment section 21 for the band W, which is formed of a frame-like member 21*a* in an approximately rectangular shape integrally formed with the insertion section 20 at an outside of one side section (hereinafter referred to as a front bar 21*b*), and a winding and engaging rod 21*c* for the band W. The winding and engaging rod 21*c* extends between a pair of side sections facing each other adjacent to the one side section (front bar 21*b*) of the frame-like member 21*a*.

Incidentally, in this embodiment, as shown in FIG. 25, an insertion passageway 21*g* for the band W, which is formed between the winding and engaging rod 21*c* in the attachment section 21 of the male buckle MB, and a side section (hereinafter referred to as an end bar 21*e*) facing the front bar 21*b* of the frame-like member 21*a*, is structured such that the band W can be easily inserted obliquely from one opening side of the frame-like member 21*a* without resistance. In this structure, after the band W is inserted from the other opening side of the frame-like member 21*a* to be located between the winding and engaging rod 21*c* and the front bar 21*b,* the band W is inserted from the open side into the insertion passageway 21*g* and is pulled again from the other opening side. In this condition, as a tension is applied to the band W, a corner edge 21*f* of the end bar 21*e,* and a corner edge 21*d* directed toward the end bar 21*e* of the winding and engaging rod 21*c* located at the one opening side described above are respectively pushed against the band W.

Accordingly, in this embodiment, by inserting the band W into the frame-like member 21*a* forming the attachment section 21 of the male buckle MB described above, the band W can be attached appropriately. At the same time, in the condition that the tension to the band W inserted as described above is released, the band W can be moved along the inclining direction of the insertion passageway 21*g,* so that the change of the attaching position of the male buckle MB along the longitudinal direction of the band W can be made easily.

Also, the insertion section 20 of the male buckle MB is formed of:

(1) a middle leg 22 projecting from an approximately middle position in the longitudinal direction of the front bar 21*b;*

(2) elastic legs 23 which are respectively spaced away from the middle leg 22 for the substantially same spaces, and which project from both ends of the front bar 21 in the direction same as that of the middle leg 22; and (3) stopping portions 24 which are located between the middle leg 22 and the respective elastic legs 23 and project respectively in the same direction as that of the middle leg 22, and which have leg shapes elongated in the insertion direction of the insertion section 20.

Figure 11:
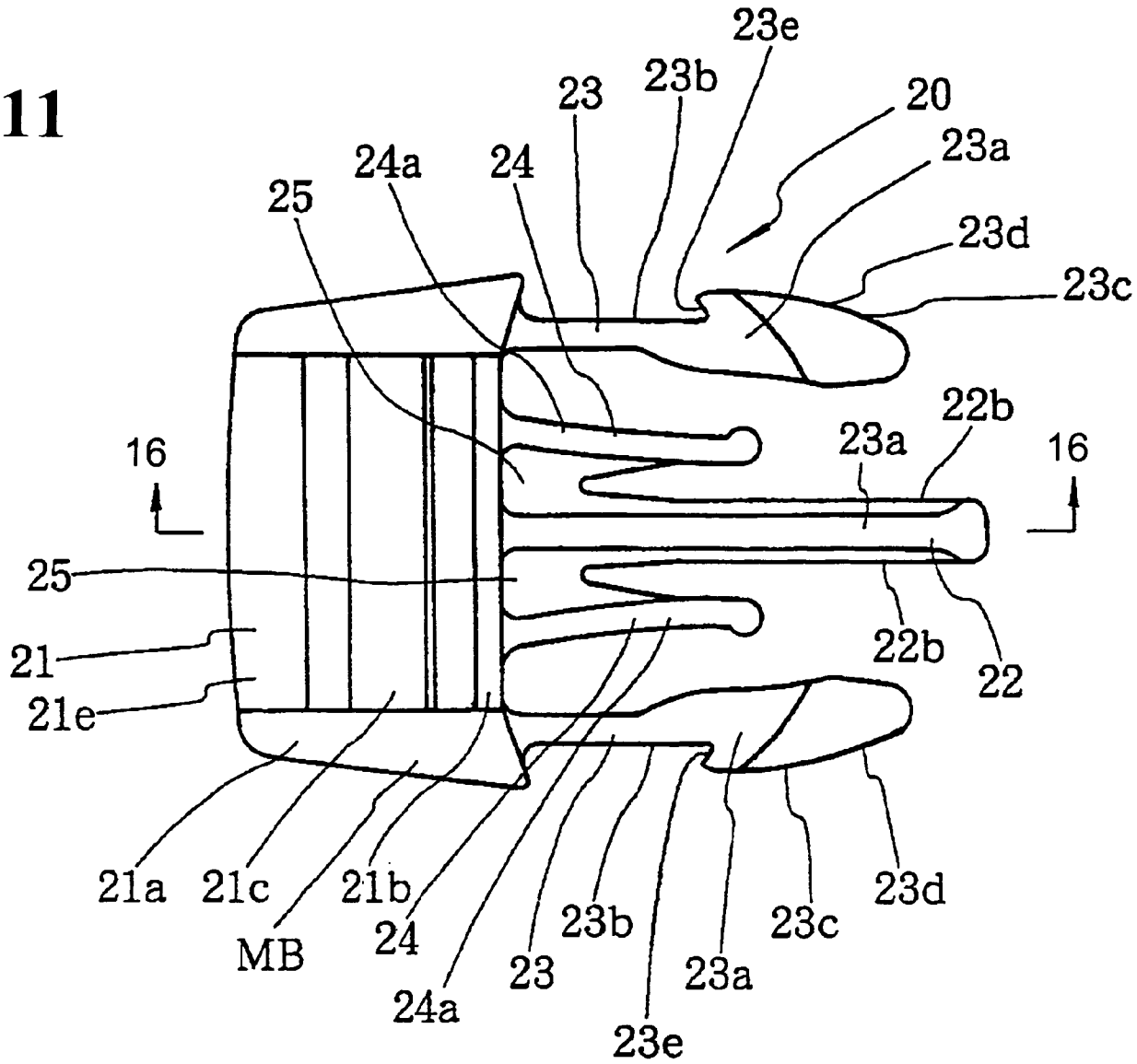
FIG. 11 is a plan view of a male buckle.
Figure 13:
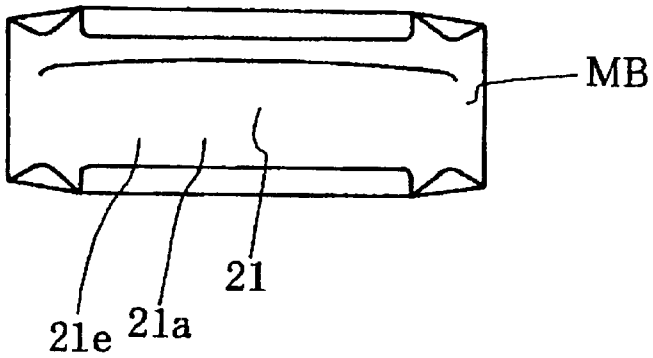
FIG. 13 is a left side view of the male buckle.
Figure 12:
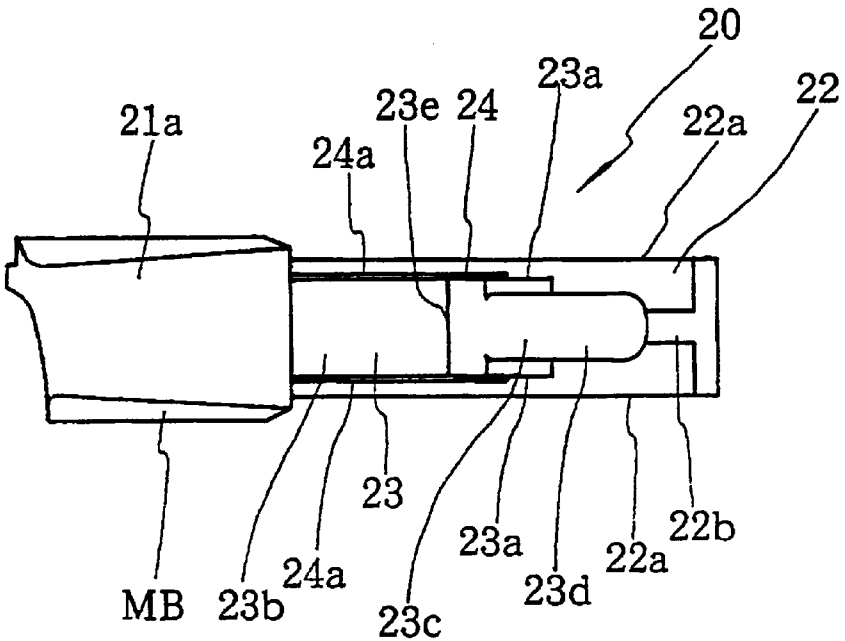
FIG. 12 is a front view of the male buckle.
Figure 14:
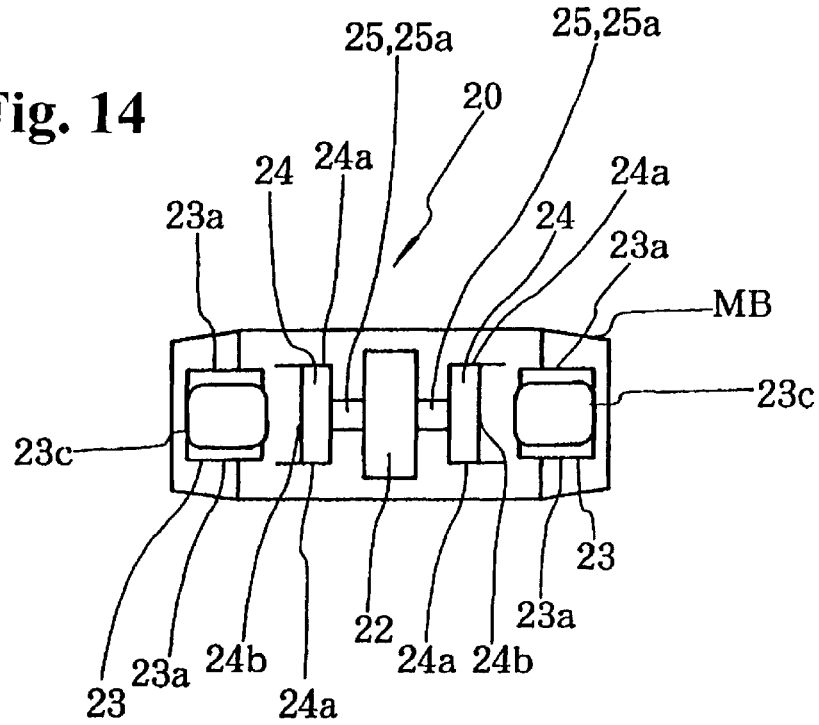
FIG. 14 is a right side view of the male buckle.
Figure 15:
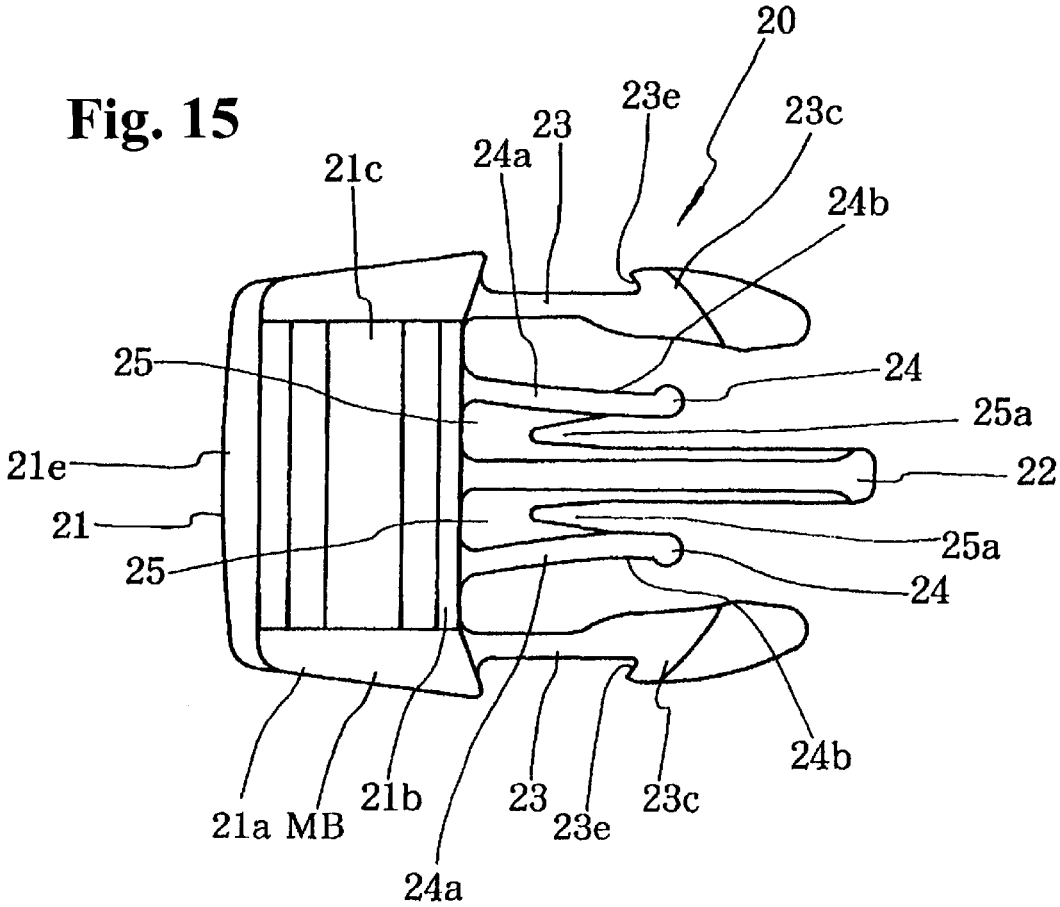
FIG. 15 is a bottom view of the male buckle.
Figure 16:
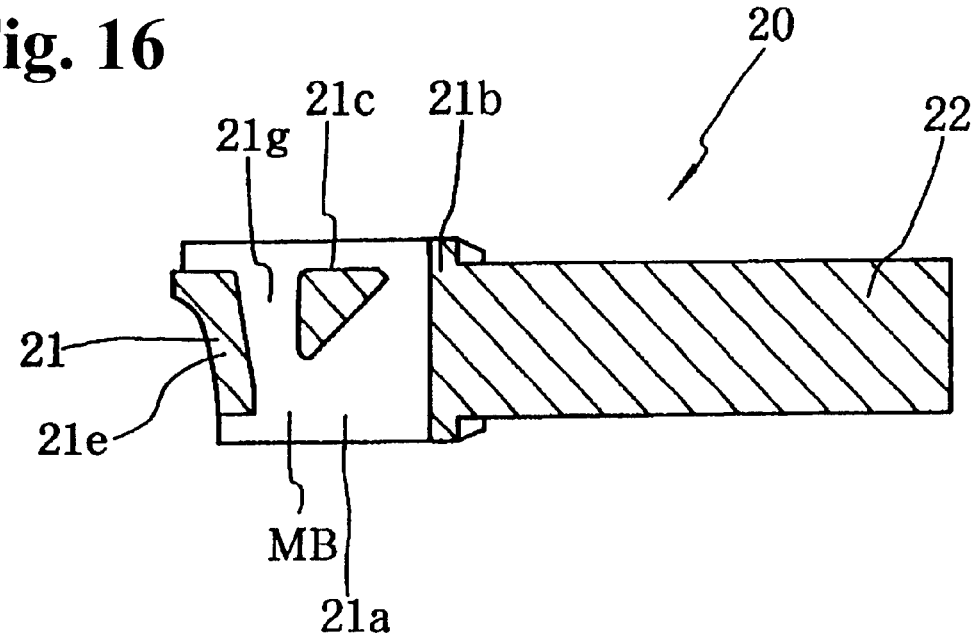
FIG. 16 is a cross sectional view taken along line 16—16 in FIG. 11.
Figure 17:
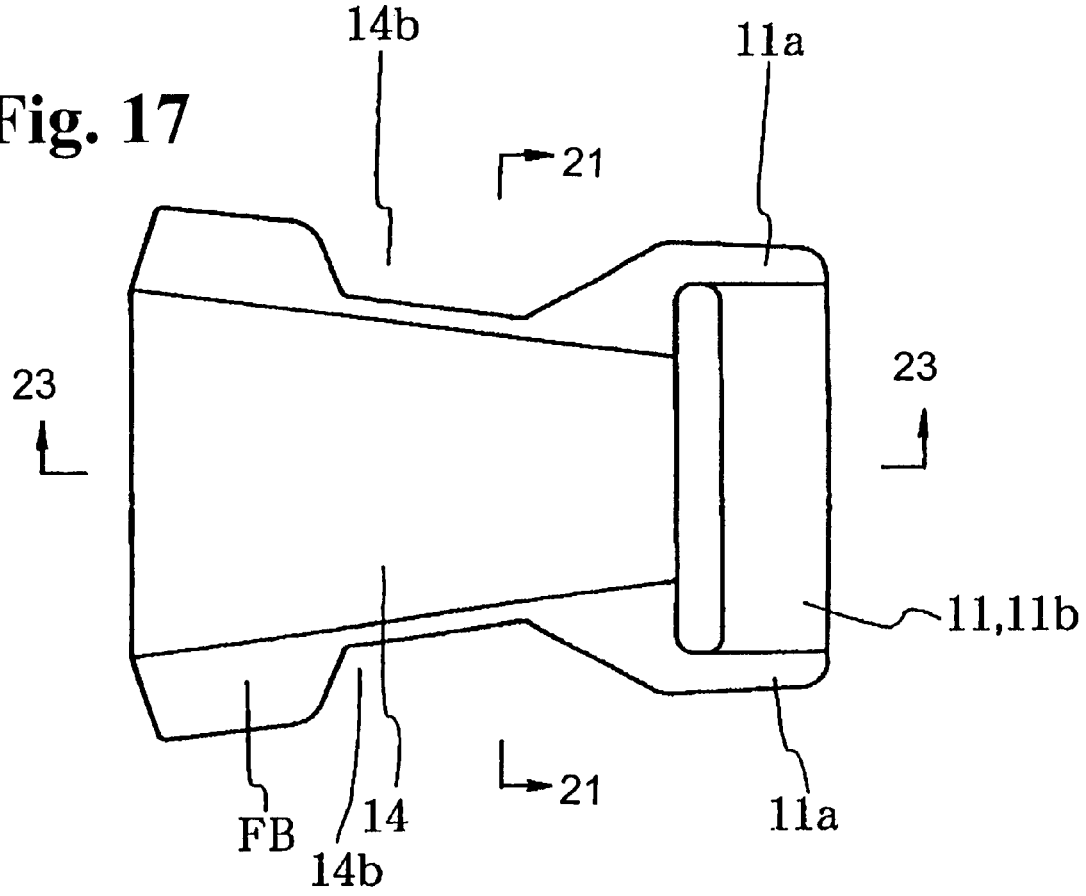
FIG. 17 is a plan view of a female buckle.
Figure 18:
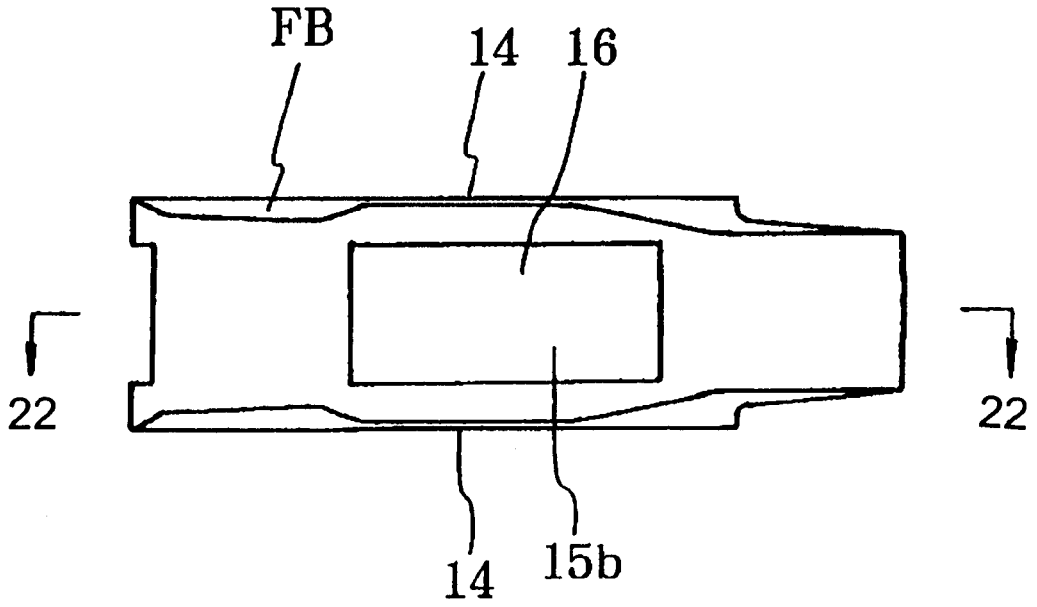
FIG. 18 is a front view of the female buckle.
Figure 19:
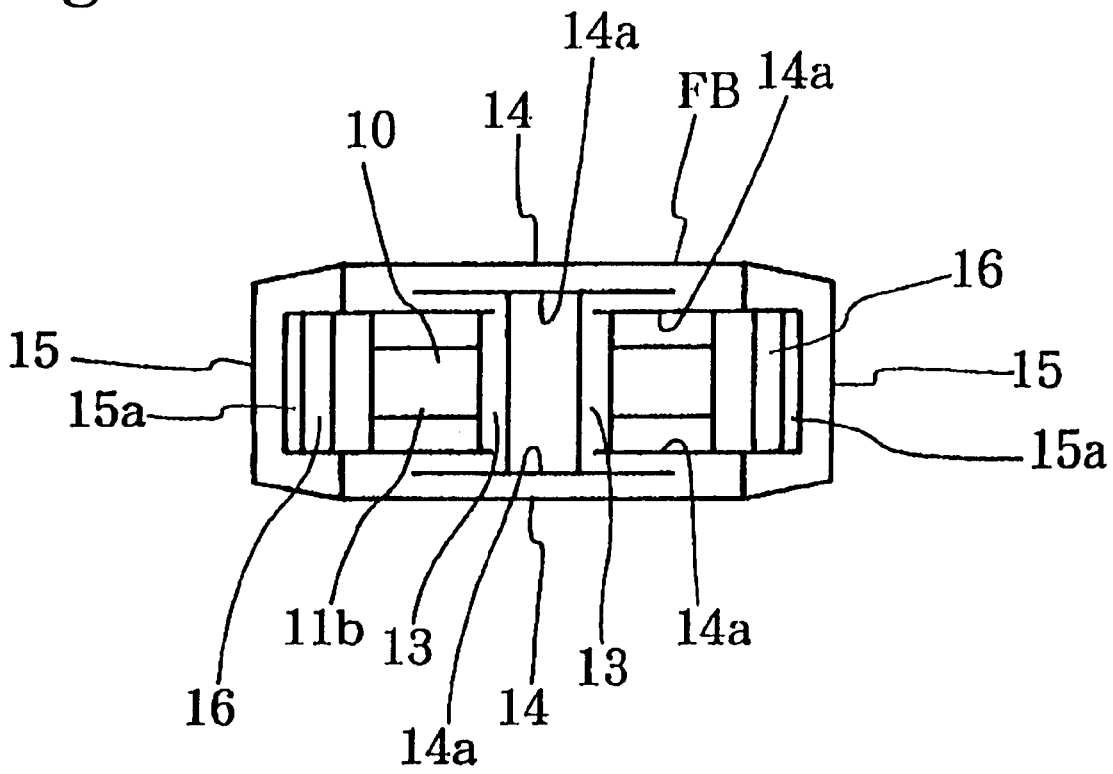
FIG. 19 is a left side view of the female buckle.
Figure 20:
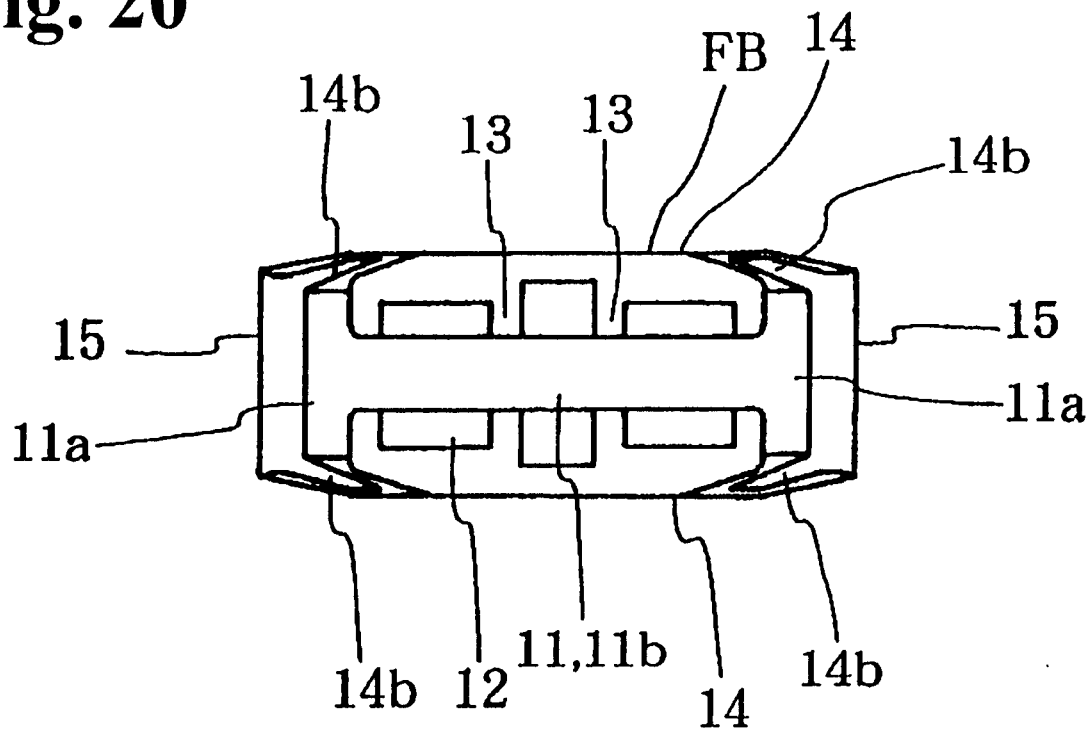
FIG. 20 is a right side view of the female buckle.
Figure 21:
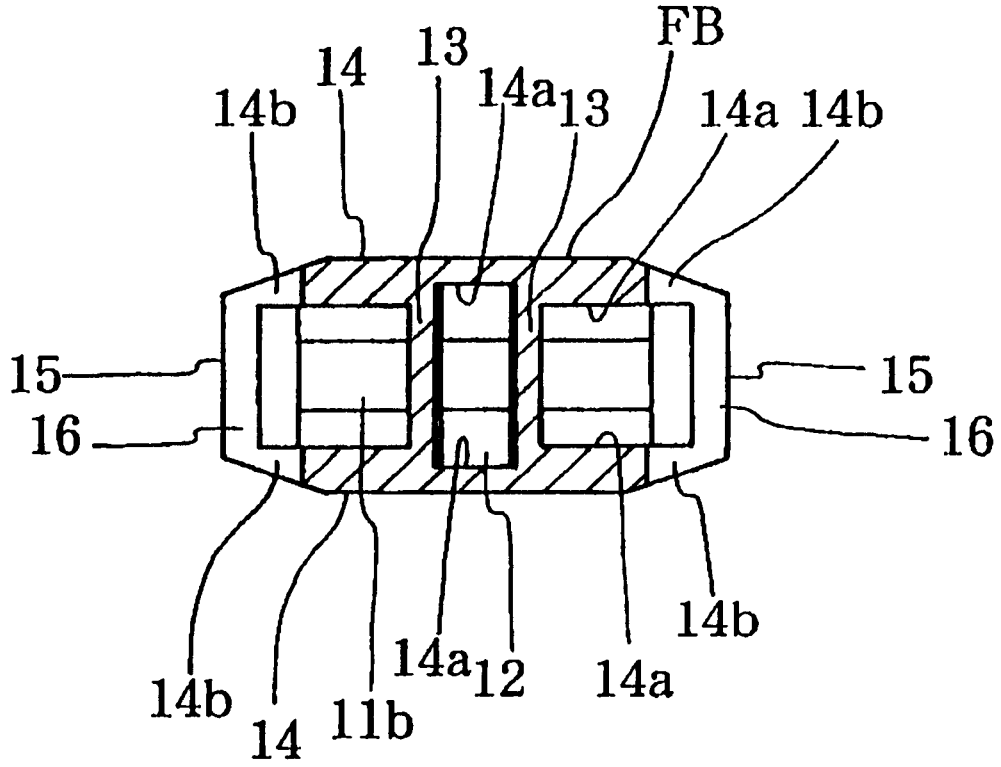
FIG. 21 is a cross sectional view taken along line 21—21 in FIG. 17.
Figure 22:
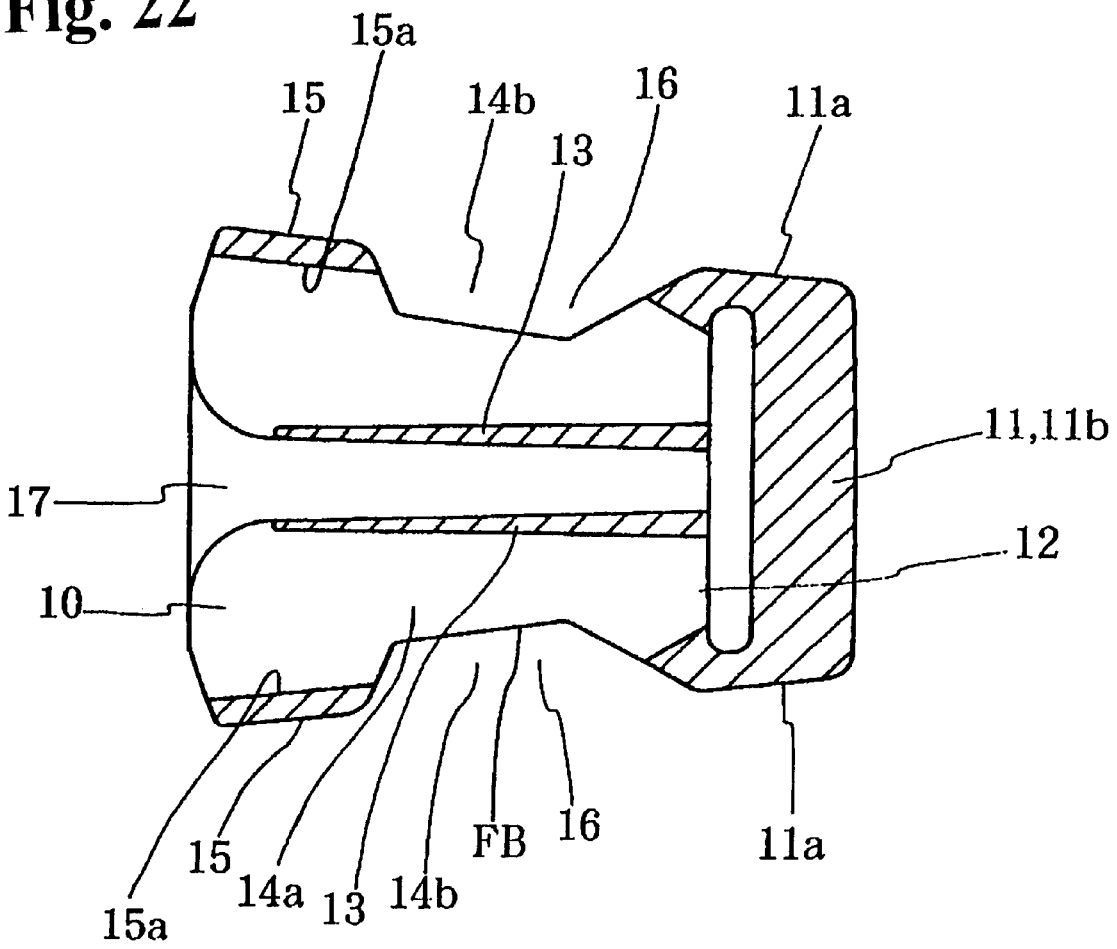
FIG. 22 is a cross sectional view taken along line 22—22 in FIG. 18.
Figure 23:
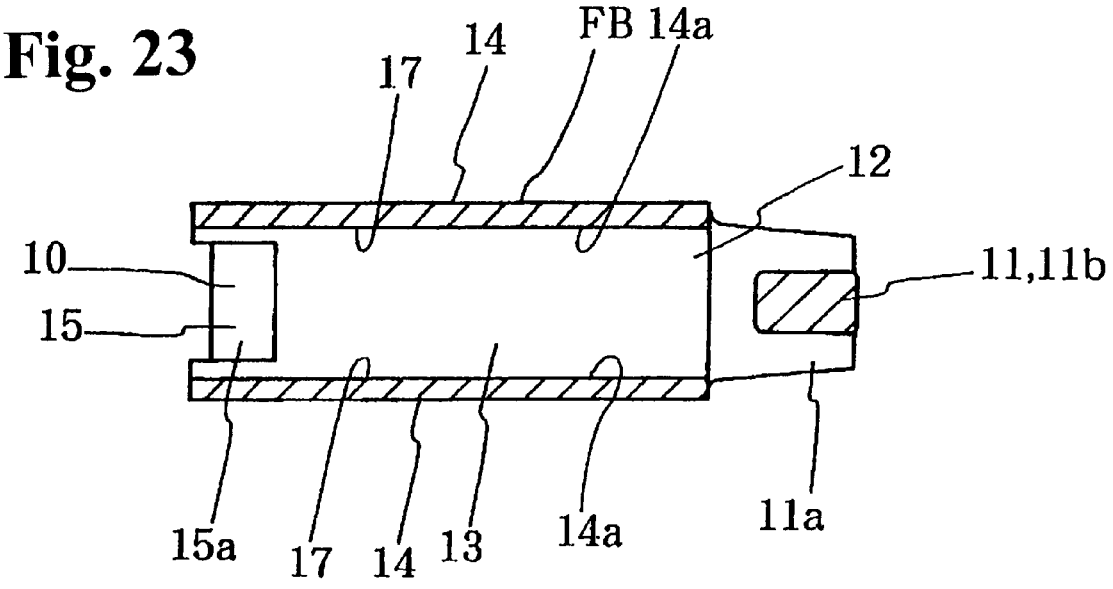
FIG. 23 is a cross sectional view taken along line 23—23 in FIG. 17.

In this embodiment, as shown in FIG. 11, the middle leg 22 is structured to have a shape of an elongated plate including wide side surfaces 22*b* and narrow upper and lower end surfaces 22*a*. Also, the elastic leg 23 is structured to have an elongated plate shape including a wide side surface 23*b* and narrow upper and lower end surfaces 23*a* (FIG. 12), and the stopping portion 24 is structured to have an elongated plate shape including a wide side surface 24*b* and narrow upper and lower end surfaces 24*a*. At the same time, the wide side surfaces 23*b* and 24*b* are formed to be directed to the same directions as those of the wide side surfaces 22*b* of the middle leg 22.

Also, in this embodiment, the elastic legs 23 are slightly shorter than the middle leg 22, and each of the stopping portions 24 has an about half length of the middle leg 22.

Further, in this embodiment, a reinforcing piece 25 in a fin-like shape is formed to extend between a base side of the middle leg 22 and a base side of the stopping portion 24, respectively. Also, in the reinforcing piece 25, there is formed a notch portion 25*a,* in which one dividing plate portion 13 at the introduction opening side of the female buckle FB, described later, is stored in case the insertion section 20 of the male buckle MB is inserted into the female buckle FB.

Also, at the sides of the elastic legs 23, which are opposite to the sides facing the middle leg 22, in accordance with an insertion of the insertion section 20 of the male buckle MB into the female buckle FB at the predetermined insertion position, there are formed engaging projections 23*c* engaging the engaging windows 16 of the female buckle FB, described later.

In this embodiment, each engaging projection 23*c* is formed at the distal end side of each elastic leg 23. The engaging projection 23*c* includes an inclined side surface 23*d* which makes the side of the elastic leg 23, not facing the middle leg 22, to be gradually widened or thickened from the end of the elastic leg 23 toward the base side thereof; and an engaging surface 23*e* which is formed such that the side of the engaging projection 23*c* in the base side of the elastic leg 23 faces an outer surface of the front bar 21*b*.

On the other hand, in this embodiment, the female buckle FB is structured into a flat and rectangular hollow shape including the wide plate portions 14 at the upper and lower sides thereof and the narrow plate portions 15 at right and left sides thereof, and further includes two pairs of inner walls 14*a* and 15*a* facing each other in each pair.

The female buckle FB is formed of:

(1) engaging windows 16 for the engaging projections 23*c* of the elastic legs 23 of the male buckle MB, wherein the engaging windows 16 are formed of notch portions 15*b* formed respectively in the narrow plate portions 15 to be spaced apart from the introduction opening 10, and notch portions 14*b* respectively formed in the wide plate portions 14 to continue from the notch portions 15*b;* and (2) a pair of the dividing plate portions 13, which are disposed so as to form a space for introducing the middle leg 22 of the male buckle MB at a substantially middle of the position in the right and left directions of the female buckle FB, wherein each of the dividing plate portions 13 has a height spanning between the inner walls 14*a* of the wide plate portions 14.

In this embodiment, the pair of the dividing plate portions 13 respectively extends from the opening rim of the end side opening 12 toward the introduction opening 10, and the dividing plate portions 13 are structured to form a space between the rim of the introduction opening 10 and rims of the dividing plate portions 13 at the introduction opening 10 side. Also, in the pair of the dividing plate portions 13, the rims thereof in the longitudinal direction are integrally connected to the inner walls 14*a* of the wide plate portions 14.

As a result, in the embodiment, the wide plate portions 14 of the female buckle FB can be supported by the pair of the dividing plate portions 13 at a center portion of the female buckle FB in the hollow shape, so that the strength of the female buckle FB can be improved without losing or deteriorating the function of the buckle.

Also, the inner walls 15*a* of the narrow plate portions 15 in the female buckle FB are structured to incline between the introduction opening 10 and the engaging window 16 such that the inner walls 15*a* gradually incline in the direction of approaching the center of the female buckle FB as the distance from the introduction opening 10 to the engaging window 16 increases.

Then, in this embodiment, the following structures are adopted.

(1) The insertion section 20 of the male buckle FB is allowed to be inserted into the female buckle FB from the introduction opening 10 of the female buckle FB in the direction of inserting the middle leg 22 between the pair of the dividing plate portions 13 (FIG. 26).

(2) In the pair of the elastic legs 23, which form the insertion section 20 to be inserted as described above, the inclined side surfaces 23*d* of the engaging projections 23*c* are gradually elastically deformed inwardly by sliding along the inner walls 15*a* of the inclined narrow plate portions 15 of the female buckle FB as the elastic legs 23 are inserted into the inside of the female buckle FB (FIG. 26).

(3) Then, the pair of the elastic legs 23 elastically deformed inwardly as described above is structured to elastically return at the insertion positions where the engaging projections 23*c* are located in the engaging windows 16, so that the engaging projections 23*c* are elastically inserted in the engaging windows 16 (FIG. 27).

(4) The engaging surfaces 23*e* of the engaging projections 23*c* elastically inserted in the engaging windows 16 as described above are engaged with window rims of the engaging windows 16 located in the introduction opening 10 side (FIG. 27).

(5) Also, from the condition that the engaging projections 23*c* are engaged with the engaging windows 16, the engaging projections 23*c* inserted in the engaging windows 16 are pressed through the engaging windows 16 toward an inner side of the female buckle FB, so that the pair of the elastic legs 23 is again elastically deformed inwardly, to thereby release the engagements between the engaging windows 16 and the engaging projections 23*c*. Accordingly, the insertion section 20 of the male buckle MB can be pulled out from the female buckle FB (FIG. 28).

(6) Furthermore, in this embodiment, in accordance with the insertion of the insertion section 20 of the male buckle MB into the female buckle FB, the stopping portions 24 are fitted outside of the dividing plate portions 13.

(7) Thus, in case the elastic legs 23 are inwardly bent by the operation of pressing the engaging projections 23*c* to pass positions of releasing the engagements between the engaging windows 16 and the engaging projections 23*c*, the distal end sides of the stopping portions 24 abut against the sides of the elastic legs 23 facing the middle leg 22, so that the elastic legs 23 are prevented from being excessively inwardly deformed (FIG. 28).

As a result, according to the buckle of the embodiment, an amount of deforming the elastic leg 23 due to the operation of bending the elastic leg 23 inwardly in order to release the engagement of the engaging window 16 and the engaging projection 23*c* can be maintained to be constant. Thus, while the elastic leg 23 has the rigidity which does not obstruct the bending operation, an unexpected deformation or breakage of the elastic leg 23 due to the excessive deforming operation of the elastic leg 23 can be entirely prevented.

Also, in this embodiment, between the pair of the dividing plate portions 13, the size between the upper end surface 22*a* and the lower end surface 22*a* of the middle leg 22 is set at a size to be stored substantially tightly between the inner walls 14*a* of the wide plate portions 14 of the female buckle FB. Also, the middle leg 22 is structured to be stored between the inner surfaces of the dividing plate portions 13 with a slight space.

Also, at the outside of the dividing plate portions 13, the size (thickness) between the upper and lower end surfaces 24*a* of the stopping portion 24 is set at a size to be held substantially tightly between the inner walls 14*a* of the wide plate portions 14 of the female buckle FB.

As a result, according to the buckle of this embodiment, in the condition of engaging both the buckles FB and MB, wherein the insertion section 20 of the male buckle MB is inserted in the female buckle FB, the insertion section 20 can be stored in the female buckle FB without movement or wobbling. At the same time, even if the external force in the direction of twisting the insertion section 20 around the central axis of the female buckle FB is applied, the condition of the engagement between the buckles FB and MB can be stably maintained.

Especially, in this embodiment, since it is structured that the stopping portions 24 are elongated in the inserting direction of the male buckle MB, in a wide range along the cylinder axis direction of the female buckle FB, the upper and lower end surfaces 24*a* of the stopping portions 24 can be substantially tightly held between the inner walls 14*a* of the wide plate portions 14 of the female buckle FB, to thereby prevent aforementioned movement or wobbling more effectively.

Incidentally, in this embodiment, up to a position where an outer surface of the front bar 21*b* of the male buckle MB abuts against the rim of the introduction opening 10 of the female buckle FB, the insertion section 20 of the male buckle MB can be inserted into the female buckle FB.

Also, in this embodiment, at the wide plate portions 14 of the female buckle FB positioned between the dividing plate portions 13, there are respectively formed grooves 17, each of which has a length extending from the rim of the introduction opening 10 to the rim of the end side opening 12 and a width for storing the middle leg 22. Additionally, between the end portion of the dividing plate portions 13 in the introduction opening 10 side and the introduction opening 10, the groove 17 is formed to gradually widen its width toward the rim of the introduction opening 10. Thus, through the grooves 17, the middle leg 22 can be easily inserted between the pair of the dividing plate portions 13.

Incidentally, in order to provide a predetermined elastic deforming characteristic to the elastic legs 23 of the male buckle MB forming the buckle described above, it is possible to form the male buckle MB by using a plastic material and a plastic molding, such as an injection molding.

According to the buckle of the invention, the strength of the female buckle in the hollow shape can be improved without deteriorating the function of the buckle and without complicating the structure thereof.

While the invention has been explained with reference to the specific embodiments of the invention, the explanation is illustrative and the invention is limited only by the appended claims.

What is claimed is:

1. A buckle, comprising:

a male buckle including an insertion section having a middle leg, two stopping portions spaced from the middle leg and disposed on two sides of the middle leg, and elastic legs disposed outside the stopping portions relative to the middle leg, each of said elastic legs having an engaging projection at a side opposite to a side facing the middle leg, and a female buckle formed of first and second pairs of inner walls facing each other to have a hollow shape, and including an introduction opening formed at at least one end thereof to allow the insertion section of the male buckle to be inserted into the female buckle; engaging windows formed in the first pair of the inner walls, said engaging windows receiving the engaging projections such that upon insertion of the insertion section, the elastic legs are deformed inwardly along the first pair of the inner walls and then return to undeformed shapes when the engaging projections enter the engaging windows; and a pair of dividing plate portions having a space therebetween for guiding the middle leg of the male buckle in an insertion operation to hold the middle leg in the space between the dividing plate portions, said pair of the dividing plate portions extending between and connecting the second pair of the inner walls of the female buckle.

2. A buckle according to claim 1, wherein each stopping portion has a thickness to be substantially tightly held between the second pair of the inner walls where the dividing plate portions are sandwiched.

3. A buckle according to claim 1, wherein said stopping portions abut against the elastic legs facing the middle leg to prevent over-bending of the elastic legs when the elastic legs are bent inwardly over positions where engagements between the engaging windows of the female buckle and the engaging projections disposed in the engaging windows are released.

4. A buckle according to claim 3, wherein each of the stopping portions has a thickness to be held substantially tightly between the second pair of the inner walls where the dividing plate portions are sandwiched.

5. A buckle according to claim 4, wherein the stopping portions extend in a direction of inserting the insertion section of the male buckle.

6. A buckle according to claim 3, wherein each stopping portion includes a forward end and a notch between the forward end and the middle leg, one of the dividing plate portions being located in the notch when the male and female buckles are engaged.

7. A buckle according to claim 6, wherein the second pair of the inner walls includes guide portions extending from edges thereof to the dividing plate portions to guide the middle leg.

8. A buckle according to claim 1, wherein each stopping portion includes a forward end and a notch between the forward end and the middle leg, one of the dividing plate portions being located in the notch when the male and female buckles are engaged.

9. A buckle according to claim 1, wherein the elastic legs have lengths in an insertion direction of the male buckle greater than lengths of the stopping portions and less than a length of the middle leg so that tips of the elastic legs are located between a tip of the middle leg and tips of the stopping portions.

* * * * *